US005611236A

United States Patent [19]

Grunwald

[11] Patent Number: 5,611,236

[45] Date of Patent: Mar. 18, 1997

[54] CRIMPING TOOL WITH MEANS TO KEEP JAWS PARALLEL

[75] Inventor: Donald R. Grunwald, Bethlehem, Pa.

[73] Assignee: Victaulic Company of America, Easton, Pa.

[21] Appl. No.: 509,019

[22] Filed: Jul. 28, 1995

[51] Int. Cl.[6] ..... B21D 9/08

[52] U.S. Cl. ..... 72/409.01; 72/409.09; 72/409.13

[58] Field of Search ..... 72/409.13, 409.14, 72/407, 453.16

[56] References Cited

U.S. PATENT DOCUMENTS

| | | | |
|---|---|---|---|
| 3,120,772 | 2/1964 | Mixon, Jr. | 72/409.14 |
| 3,345,856 | 10/1967 | Werner et al. | 72/409.13 |

FOREIGN PATENT DOCUMENTS

| | | | |
|---|---|---|---|
| 2531356 | 1/1977 | Germany | 72/407 |

*Primary Examiner*—David Jones
*Assistant Examiner*—John Paradiso
*Attorney, Agent, or Firm*—Abelman, Frayne & Schwab

[57] ABSTRACT

A tool for crimping a compression sleeve onto a pipe includes support arms [50] that rotate about fixed pivots [68], and which each carry a slidably mounted crimping jaw [52] that is supported by the associated arm [50] for rotational movement of the jaw about the longitudinal axis thereof, movement of the respective jaws [52] being guided by ramp cams [58] and camming surfaces [60] which are operative to maintain the end faces of the jaws in true parallelism with one another, despite the movement of the jaws [52] about an arcuate path, and, the rotation of those jaws [52] relative to the support arms [50], movement of the jaws being under the influence of sliding surface contact of the camming members in the absence of line contact, while at the same time a greater sliding area between the respective jaws and their associated support arms is provided, thus enhancing the durability of the crimping tool.

5 Claims, 6 Drawing Sheets

CRIMPING TOOL WITH MEANS TO KEEP JAWS PARALLEL

FIELD OF THE INVENTION

This invention relates to a crimping tool for use in assembling tubular compression couplings onto lengths of pipe.

A compression coupling comprises a tubular sleeve containing O-rings which is compressed in radial directions in order to engage the compression coupling with the respective ends of pipes, and in so doing, form a leak resistant joint between the pipe ends, the joint itself having considerable mechanical strength and being self supporting in the absence of ancillary support members.

BACKGROUND OF THE INVENTION

In order to form a successful compression joint using a compression sleeve, one of the major considerations is that the crimping tool shall not scuff, cut, scrape or gouge the compression sleeve during the crimping operation.

Further, it is essential that the crimping jaws approach each other in end-to-end parallelism. If the jaws do not engage each other in end-to-end parallelism, then, there is a probability of pinching and cutting of the compression sleeve at one point around the circumference thereof, while other points on the circumference of the compression sleeve are not fully compressed.

This can result in a faulty joint, in that blow-out and leakage can occur at the damaged portion of the compression sleeve when the pipe line is subjected to pressure, and, in the alternative, leakage axially of the pipe can occur at the insufficiently compressed portions of the compression sleeve For this reason, crimping tools for use in assembling compression couplings are required to include crimping jaws that can move radially with respect to the longitudinal axis of the compression sleeve.

However, a simple pliers type linkage cannot successfully accomplish that movement in that the jaws of the pliers are each moving on an arcuate path. The result is that considerably more force is exerted on the compression sleeve on its radius closest to the pivot of the pliers, with a danger of cutting of the compression sleeve at that radius, while at the same time lesser and possibly insufficient compressive force is exerted at the diametrically opposite radius.

For this reason, it was proposed in German patent 3,423,283 published Jan. 2, 1986 to provide a crimping tool in which opposite jaws of the crimping tool are moved in parallelism with each other when progressing from the open position of the crimping tool to the closed crimping position thereof.

In order to accomplish that movement, this prior teaching requires the crimping jaws to be positionally held by rollers attached to the respective jaws, and which are moved along cam tracks in a support plate during their movement between the opened and closed positions of the jaws. Further, the jaws are required to ride on ramp cams, which further act to guide the jaws in parallelism with each other during a closing movement of the jaws.

Crimping tools of this type encounter extremely high working pressures when in use. This in turn results in rapid wear of the rollers and their associated journals, and in turn, results in rapid wear of the ramp cams, and further in turn results in the jaws being free to approach each other other than in true parallelism, due to play in the mechanism.

These problems are further exaggerated due to the fact that the rollers engage their cam tracks in line engagement only, and also, the jaws engage their ramp cams in line engagement only.

In the event that there is play in the mechanism, and the crimping jaws approach the compression sleeve other than in parallelism with each other, then, gouging and scuffing and possible cutting of the compression sleeve will result, and also, the compression sleeve can be compressed off-center with respect to its longitudinal axis, this resulting in over compression of the O-rings at one radius of the compression sleeve and possible destruction of the O-ring at that location, and a diametrically opposite insufficient compression of the O-ring resulting in leakage axially of the pipe at that location.

In order to eliminate these disadvantages in the prior art crimping tool of German patent 3,423,283, it is proposed in U.S. Pat. No. 5,148,698 issued Sep. 22, 1992 to provide a crimping tool having three crimping jaws, one of which is fixed relative to the frame of the crimping tool, and, the other two of which can slide within the supporting arm of those jaws, in this manner to produce a crimping force that approximates a truly radial compression on the compression sleeve.

This U.S. patent teaches that the three dies move in a radial fashion when crimping a fitting. In practice, for that to happen, a multitude of factors have to be taken into consideration, with at least one of those factors being beyond the control of the jaw manufacturer.

In order to produce a truly radial motion of the jaws, the friction between the dies and the fitting must be within a very narrow range. If it is not within that range, the preloaded springs that are used to initially position the two moving dies, will not be at the right pre-load pressure to compensate for the friction loads. In practice, the friction imposed on the jaws can vary to a large extent, the result being that in practice the dies do not always come together in a truly radial path, this resulting in a non-uniform crimp.

When this happens, the pipes that are being joined to fittings do not always stay in axial alignment with the fittings. This is because of angular deflection between the pipe and the fittings caused by a non-uniform crimp geometry due to the dies moving in a non-uniform manner. Non-uniformity of the crimp can result in severe fitting pinching at the die corners, and, failure of the dies to close fully.

Additionally, dirt builds up between the respective die segments, which requires cleaning of the dies as an every day occurrence. If dirt is present between the dies as they come together, the dirt prevents full closure of the dies, this resulting in an incomplete crimp. This problem is compounded according to the teachings of U.S. Pat. No. 5,148,698, in that dirt readily accumulates at the juxtaposed faces of the fixed die and the movable dies, the positioning of those juxtaposed faces making the crevice between the juxtaposed faces hard to access and to clean.

Further, the three-jaw design of the prior art severely limits how far the jaws can be opened, this in turn requiring the crimping tool to be fit over the pipe and then slid axially of the pipe and over the fitting before a crimping operation can be effected.

The use of one fixed and two movable compression jaws results in three points around the circumference of the compression ring that can be subjected to possible pinching and gouging of the compression sleeve at those points.

Further, the compression tool itself is of complex construction and expensive to manufacture.

Further, while it is expected that the durability of the tool will be greater than that described in German patent 3,423,283, it is subject to wear on the sliding faces of the two movable jaws, which, owing to the requirement for one fixed and two sliding jaws, must be of reduced sliding contact area with their supporting arm.

OBJECT OF THE INVENTION

It is an object of the present invention to provide a crimping tool that eliminates camming rollers and their associated cam tracks, and which also eliminates ramp cams that are engaged by the jaws in line engagement.

It also is an object of this invention to provide a crimping tool having only two jaws, thereby to reduce the number of points at which the compression sleeve is pinched, while at the same time providing for enhanced bearing surface areas between the compression jaws and their supporting arms, and in turn a lower rate of wear of sliding surfaces of the jaws relative to their supporting arms.

The further object of this invention is to provide a crimping tool having crimping jaws that are smaller in overall size than those previously proposed, thus allowing the jaws to be lighter in weight. This provides two user benefits, as the crimping tool is smaller than that previously proposed it can get into tighter spaces, and, being lighter, is more easy to handle by a workman. Further the crimping tool of the present invention has fewer moving components, and, eliminates numerous concentrated load-bearing contact surfaces, thus extending the severed life of the crimping tool.

SUMMARY OF THE INVENTION

According to the present invention, the crimping tool is comprised of two compression jaws, each rotatable relative to their associated supporting arm, about an axis extending substantially parallel to the longitudinal axis of the tubular sleeve.

Each of the jaws includes a camming surface, that, upon closing of the jaws, respectively engages a ramp cam positioned on a stationary member of the crimping tool in sliding surface area engagement therewith.

the inter-engaged surfaces of the ramp cams and the camming surfaces of the jaws progressively increases in area as the jaws move from the open position to the closed position thereof, the respective jaws being mounted for rotation within their respective support arms about the longitudinal axis of the compression sleeve.

The geometry of the pivots for the support arms is so arranged that upon an opening or closing movement of the jaws, the camming surfaces of the jaws ride on the ramp cams in continuous face engagement therewith, the jaws moving relative to each other truly in parallelism with one another.

DESCRIPTION OF THE DRAWINGS

The invention will now be described with reference to the accompanying drawings illustrating a preferred embodiment of the present invention, and, in which.

DESCRIPTION OF THE PRIOR ART

Figure 1:
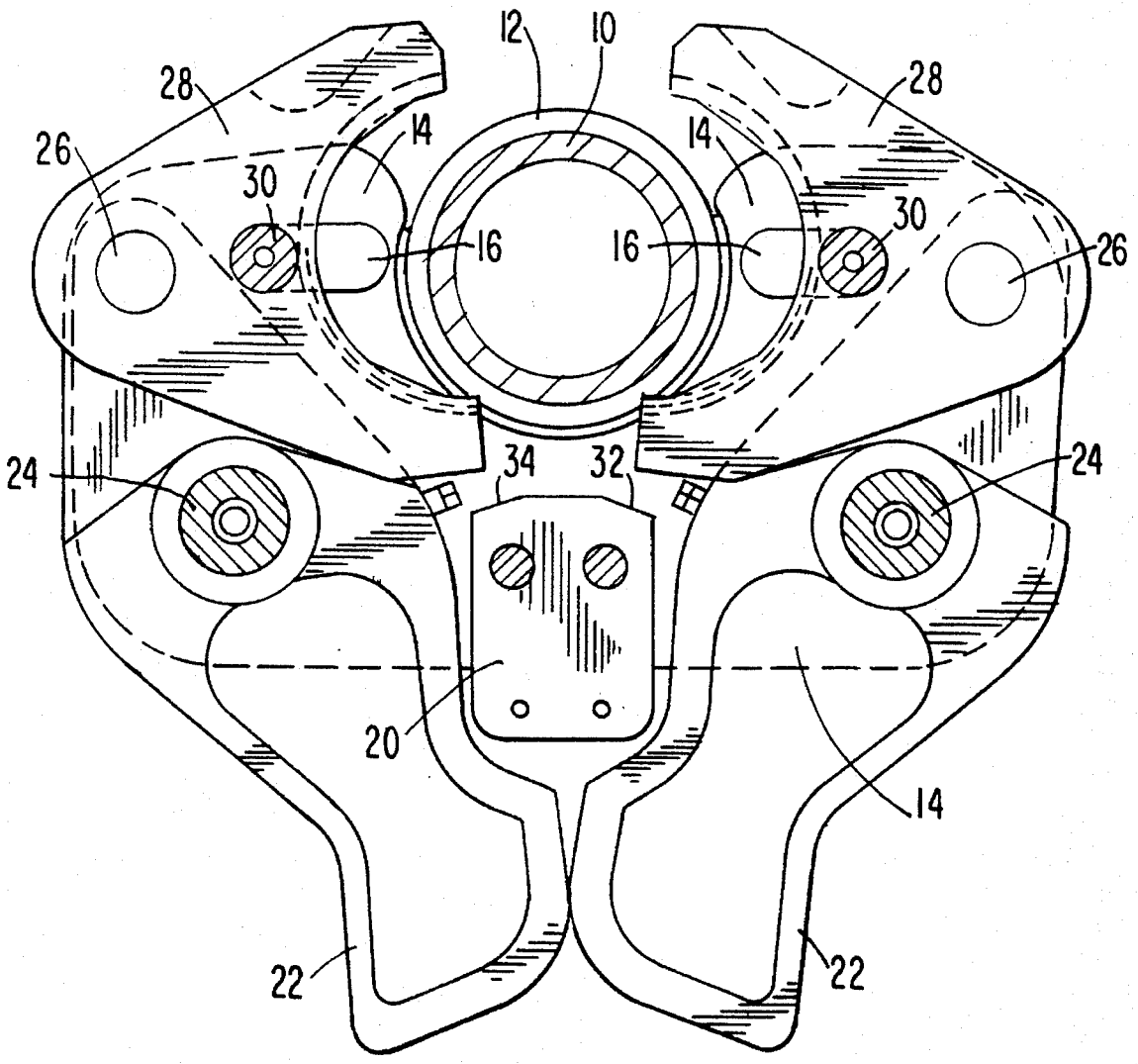
FIG. 1 PRIOR ART
FIG. 1 is an illustration of a prior art crimping tool when in an opened position.
Figure 2:
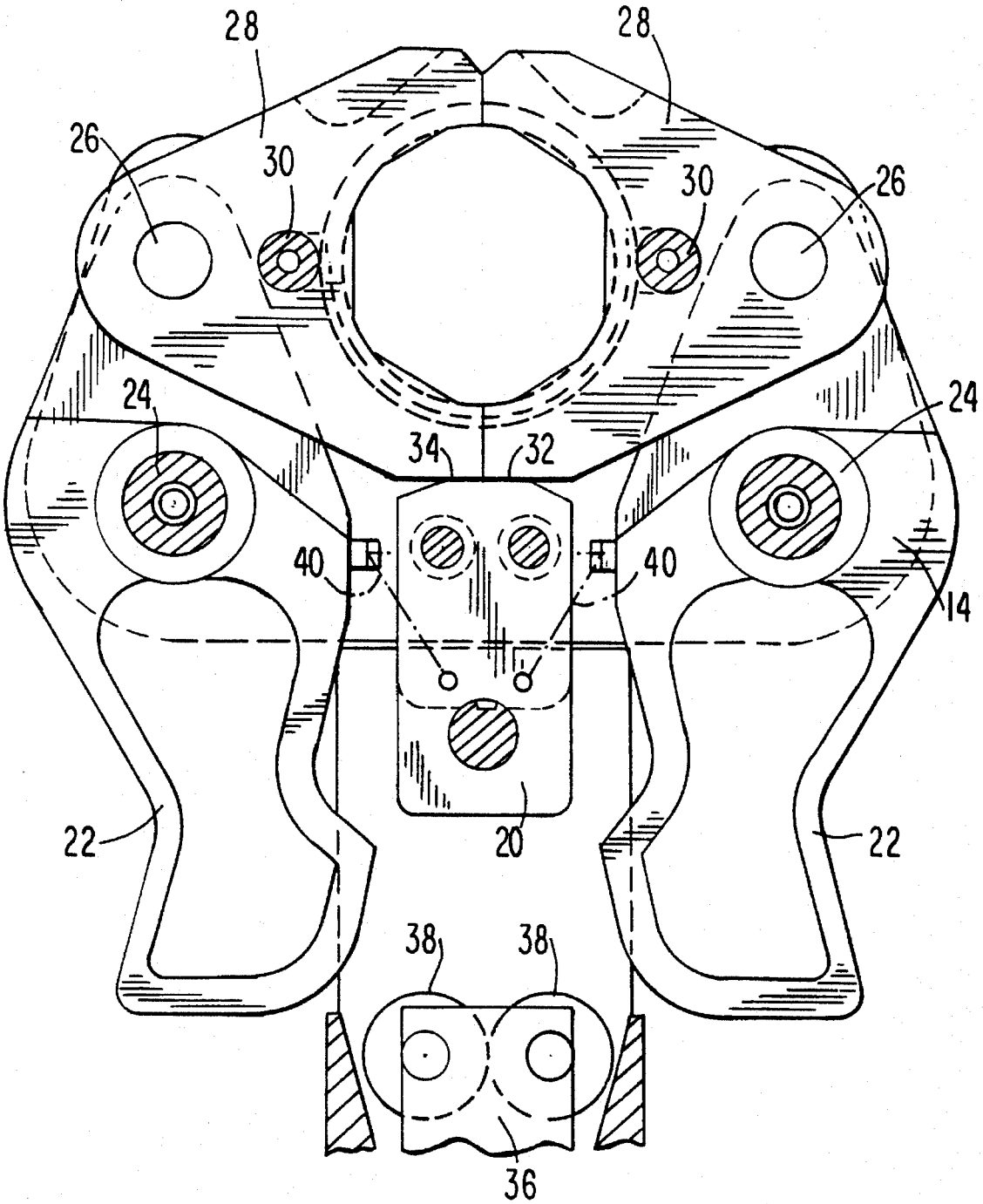
FIG. 2 PRIOR ART
FIG. 2 is a view corresponding with FIG. 1 showing the crimping tool of the prior art when in a fully closed position.

Referring now to FIGS. 1 and 2, in which the same reference numerals have been employed to denote the corresponding parts of the crimping tool, a crimping tool is shown of the type disclosed in German patent 3,423,283.

FIG. 1 shows the crimping tool of the prior art when in a fully opened position, and in a condition in which it can receive or be positioned over a pipe 10 surrounded by a compression sleeve 12, the compression sleeve being of any known form.

The crimping tool itself includes a pair of relatively massive side plates 14, each of which is provided with camming slots 16 on their mutually presented faces, the side plates 14 being held in spaced-apart relation by a central spacer block 20.

The parallely arranged side plates 14, only one of which is shown in FIG. 1, have sandwiched between them support arms 22 that are mounted for pivotal movement between the side plates 14 by pivots 24, the support arms being pivoted at 26 to a crimping jaw 28, the crimping jaws 28 each carrying a roller 30 that tracks within the camming slots 16 in the respective side plates, in order to guide the crimping jaws 28 in parallelism with each other at the time the crimping tool is moved to the closed position, as is illustrated in FIG. 2.

As will be immediately apparent, in moving from the open position as shown in FIG. 1 to the closed position as shown in FIG. 2, the crimping jaws 28 have been brought into engagement with ramp cams 32 and 34 provided on the upper surface of the central space block 20, the ramp cams 32 and 34 being necessary in order to maintain the crimping jaws 28 in parallelism with each other.

This is because the respective pivots 26 are moving on arcuate paths, and thus, are rising at the time the end faces of the respective crimping jaws 28 approach each other. In the absence of the ramp cams 32 and 34, the crimping jaws 28 could move into a position in which their end faces are angled relative to each other, a condition that specifically is to be avoided if a successful crimp in a crimping sleeve is to be obtained.

The ramp cams 32 and 34 are required in addition to the rollers 30 and the cam slots 16, in that any wear of the rollers and their supporting shafts, or wear of the camming surfaces of the slots 16, such as will occur from normal use of the tool, will be magnified at the end faces of the crimping jaws 28 by reason of the linkage employed to move the jaws 28. Further, wear on the pivots 24 and 26 can further exaggerate the problem.

Commencing with the tool in the position shown in FIG. 1, the tool is either placed over the crimping sleeve 12 assembled onto the pipe 10, or, the assembled pipe 10 and crimping sleeve 12 are inserted between the crimping jaws 28.

Then, as shown in FIG. 2,and by means of a hydraulic ram attached to the central spacer block 20, the piston 36 of which carries anti-friction rollers 38, the support arms 22 are forced oppositely away from each other into the position shown in FIG. 2. In turn, this causes the rollers 30 to traverse the camming slots 16 to orient the end faces of the crimping jaws parallel to each other, and also, to cause the lower edges of the crimping jaws 28 to engage the respective ramp cams 32 and 34.

During the final closing portion of the movement, the ramp cams 32 and 34 cause the end faces of the respective crimping jaws to rise in unison, the crimping jaws themselves being at that time raised due to the fact that the pivots 26 each are moving on an arcuate path comprised of a radius from the associated pivot 24.

It will be noted that the rollers 30 engage the camming slots 16 in line engagement. Also, it will be noted that the crimping jaws 28 engage the respective ramp cams 32 and. 34 also in line engagement. Extended use of the crimping tool will cause wearing of the camming slots 16 of the rollers 30, and the support shafts for the rollers, and also will cause wear on the ramp cams 32 and 34, and, the points at which the jaws 28 engage the respective ramp cams 32 and 34 in line engagement.

Extended use of the tool will result in wear at the various points, and, eventually, the crimping jaws 28 will not be moved in true parallelism with each other, but instead, will assume random angled positions of their end faces relative to each other.

If the crimping jaws 28 approach the compression sleeve 12 other than in true parallelism, then, the crimp effected in the compression sleeve will be irregular with the problems of scouring, gouging and possibly cutting of the compression sleeve at one end face of one of the jaws, with possible destruction of the contained O-ring, while at the opposite end face of that jaw, the compression sleeve 12 may be inadequately compressed, this permitting leakage past the O-ring in a direction axially of the contained pipe.

Those conditions cannot be tolerated in the assembly of a piping system, in that once the compression sleeve has been crimped in a faulty manner, then, it must be cut off the pipes, removed from the pipes, a replacement compression sleeve then positioned over the adjacent ends of the pipes, and then, the crimping operation be repeated.

More importantly, the fault may be unnoticed upon initial assembly of the pipeline, which may test for sufficiency. At a later date and after the entire piping system has been assembled and in operation for several months, the faulty compression coupling possibly can fail, with disastrous consequences, and, very considerable expenses in effecting repairs.

To release the support arms 22 from the closed position, the hydraulic ram 36 carrying the rollers 38 is retracted, this permitting the support arms 22 to move from the position shown in FIG. 2 back to the position shown in FIG. 1, under the influence of springs indicated diagrammatically at 40.

DESCRIPTION OF THE PREFERRED EMBODIMENT

Figure 3:
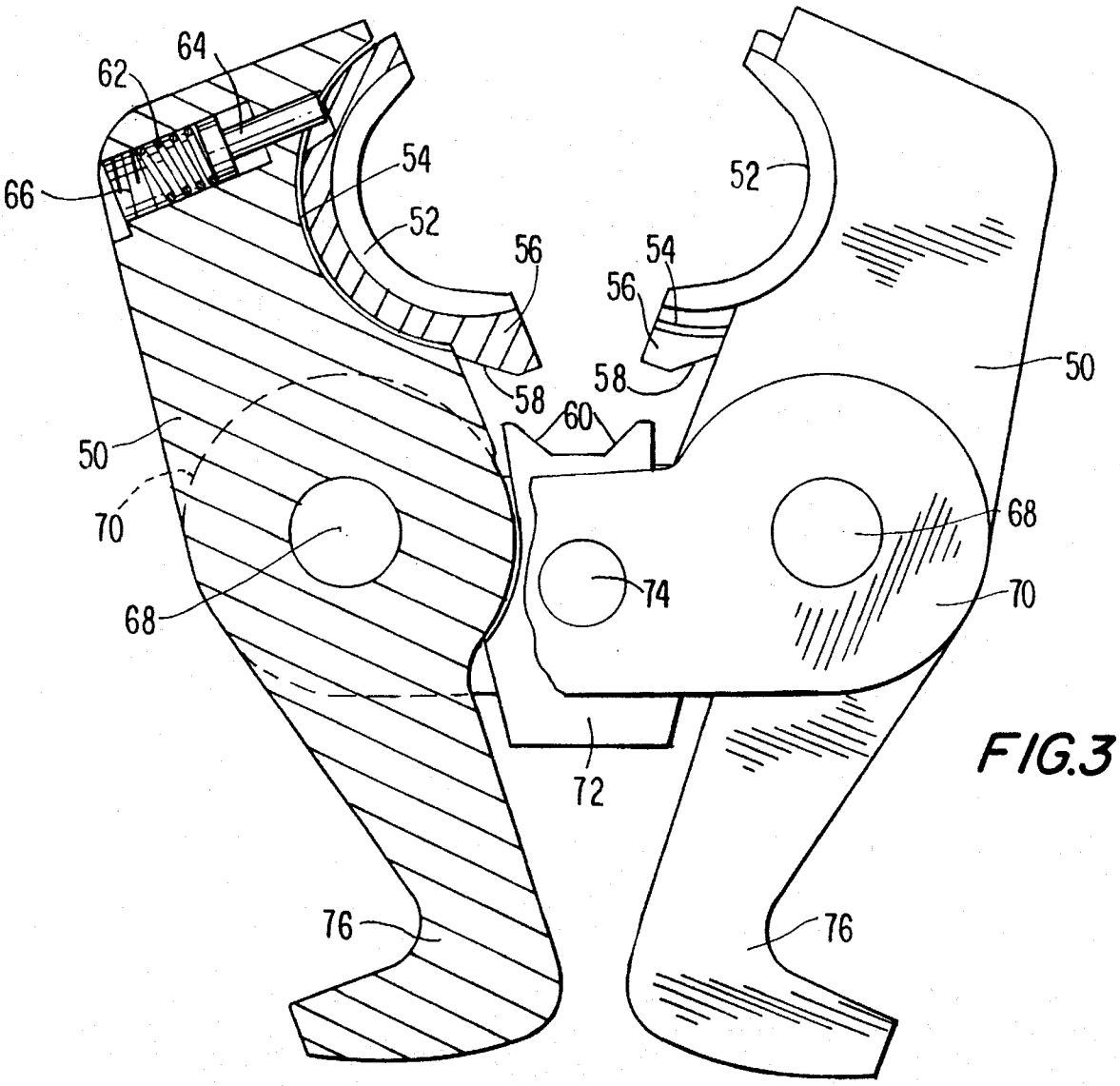
FIG. 3 illustrates a crimping tool according to the present invention when in a fully opened position.
Figure 4:
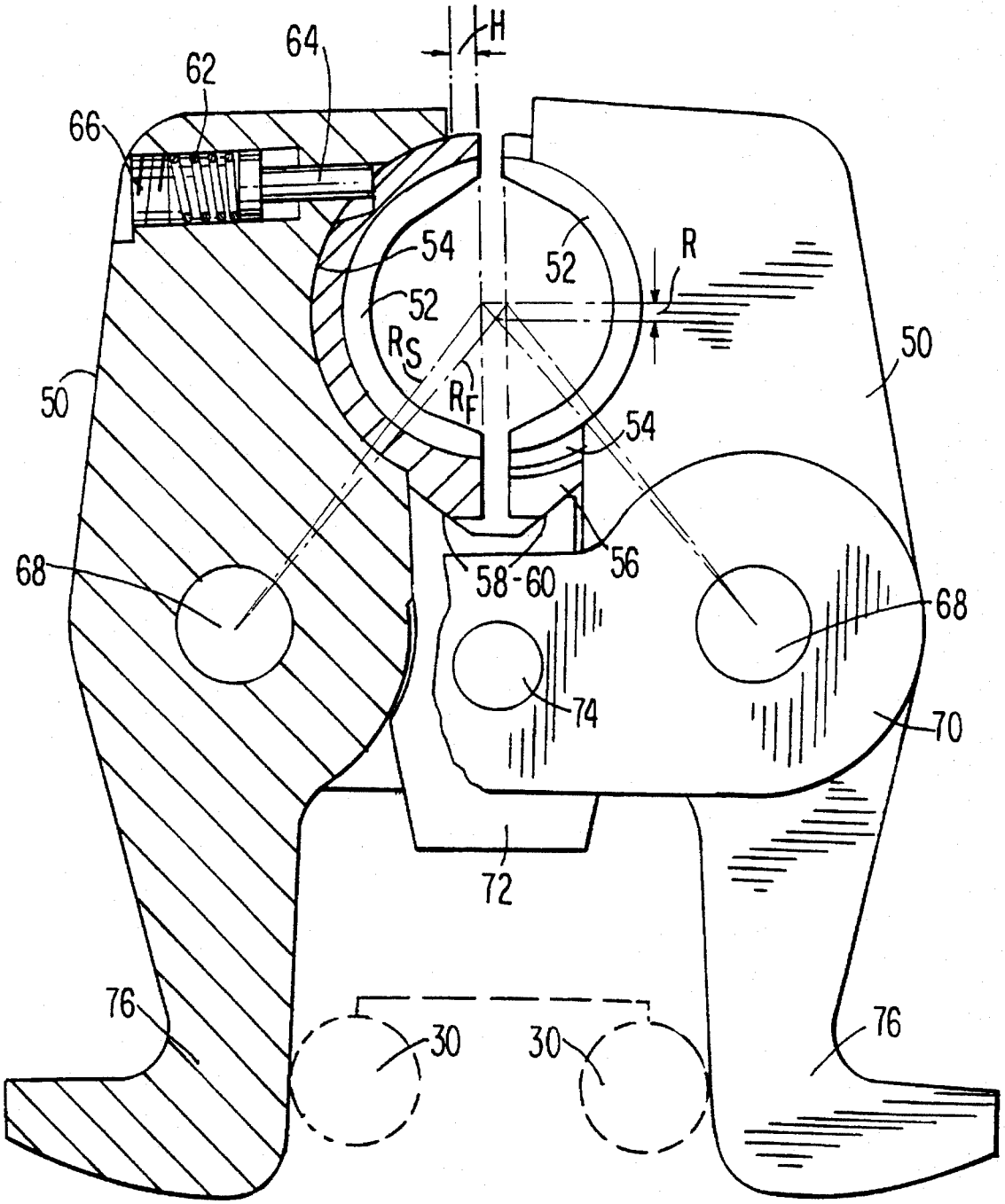
FIG. 4 illustrates the crimping tool of the present invention when in a partially closed position in readiness to effect a crimping operation.
Figure 5:
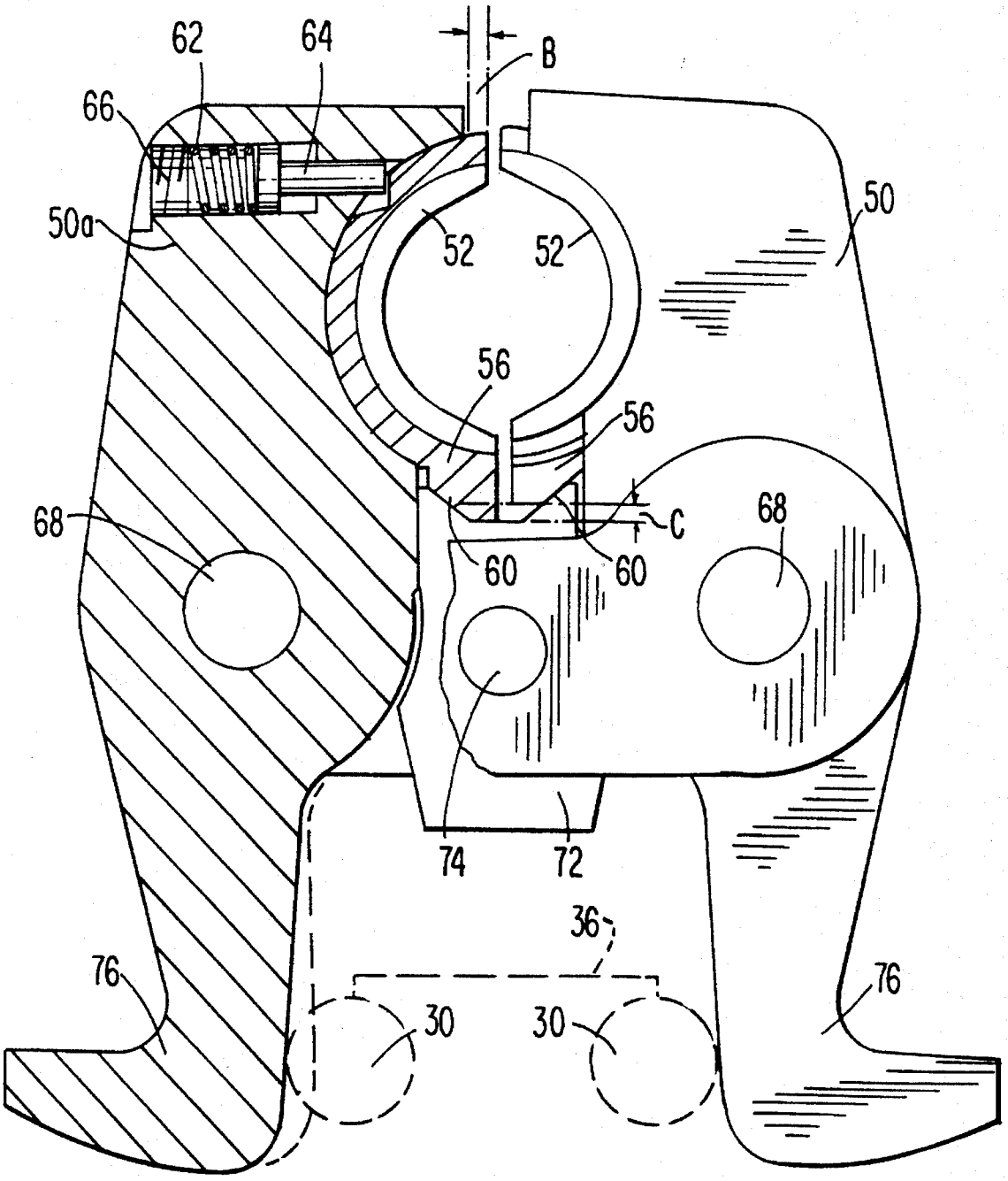
FIG. 5 is a view corresponding with FIG. 4, but, showing one of the crimping jaws when in the fully advanced crimping position, the other jaw being shown, for the purposes of comparison, when in a condition readied for effecting the crimping operation; and, FIG. 6 is a view corresponding with FIG. 4, showing the crimping jaws when in a fully closed position.
Figure 6:
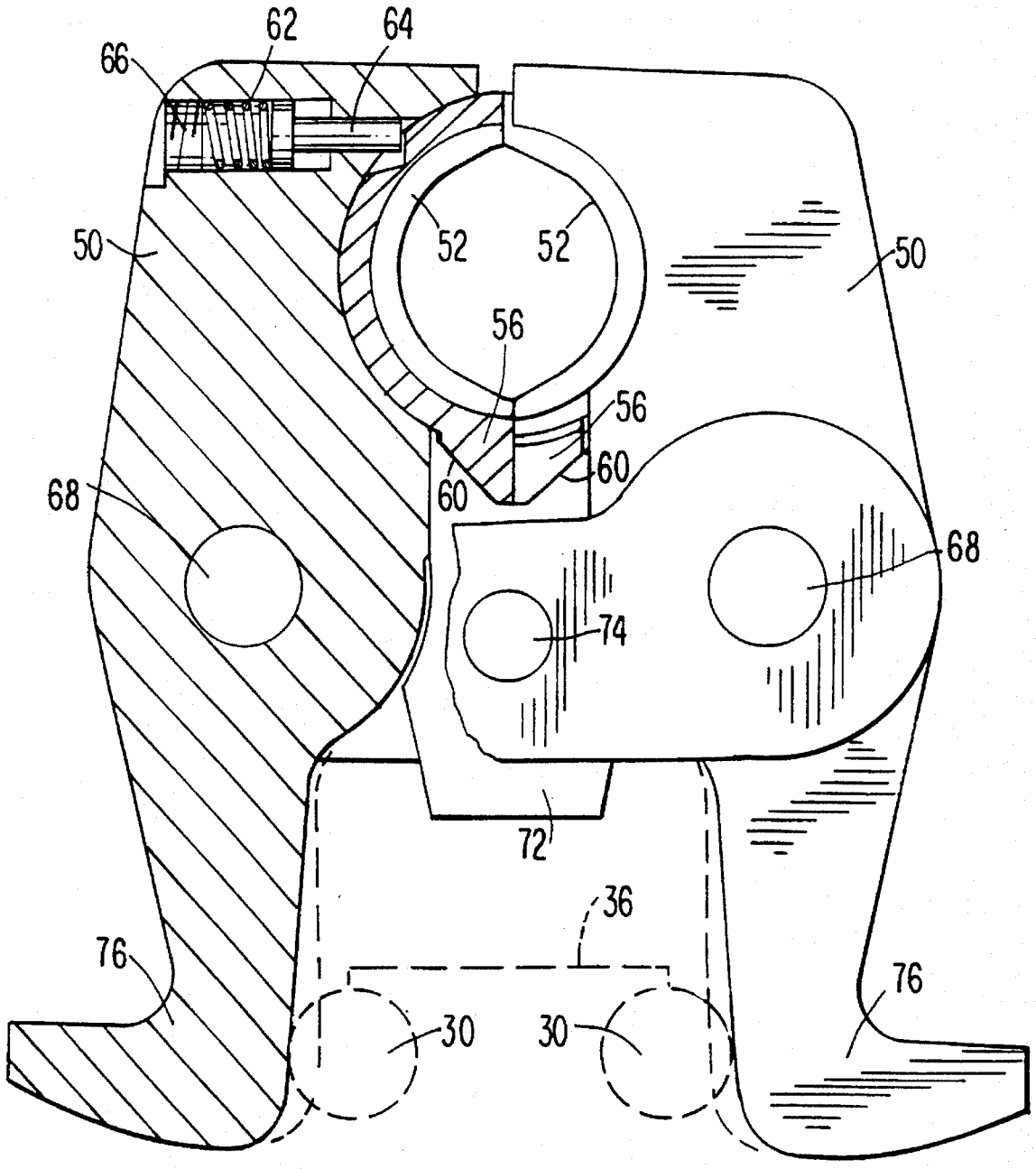

A preferred embodiment of the invention will now be described with reference to FIGS. 3 through 6, of which FIG. 3 shows the crimping tool when in a fully opened position in readiness to receive a compression sleeve assembled onto the pipe ends, FIG. 6 shows the crimping tool when in a fully closed position, and, FIGS. 4 and 5 show the crimping tool when in positions intermediate the fully opened and fully closed positions of the crimping tool.

Referring now to FIG. 3, the crimping tool includes two pivoted support arms 50, each of which carries a jaw 52, that is slidably mounted in the associated support arm by slide tracks 54, for rotational movement of the respective jaws about the longitudinal axis of those jaws.

Each of the jaws 52 is provided with a camming member 56 that includes a ramp cam 58, for cooperation with camming surfaces 60 on an anvil 72.

The respective jaws 52 each are biased into a starting position in which the respective camming members 56 are in engagement with the respective support arms 50. For this purpose, a spring 62 is provided in each of the arms 50, the spring 62 reacting against a push rod 64, and being held under compression by a grub screw 66.

The respective support arms 50 each are pivoted at 68 between spaced side plates 70 between which the support arms 50 are sandwiched.

The anvil 72 either can be fixedly mounted between the side plates 70, or, can be pivotally mounted thereon at 74.

In use, the pipes and the compression sleeve [not shown] are inserted between the jaws 52, and then, the support arms 50 are rotated about the respective pivots 68, in order to bring the jaws 52 into the position shown in FIG. 4.

In FIG. 4, the jaws 52 are shown in a position in which the ramp cams 58 have made initial engagement with the camming surfaces 60, and, prior to rotational movement of the jaws 52 relative to their respective support arms 50.

As will be apparent from FIG. 4, the respective support arms 50 have moved angularly about their pivots to an angular position Rs, i.e., they each have been moved accurately about the respective pivots 68.

In so doing, the ramp cams 58 or the respective camming members 56 have been brought into surface engagement with the camming surfaces 60, in readiness for subsequent sliding movement of the ramp cams 58 over their associated camming surfaces 60 in face engagement with the camming surfaces 60.

The face engagement of the ramp cams 58 with the camming surfaces 60 is of importance in that a relatively large area of contact is provided in true face-to-face contact, that is operative to reduce wear on the ramp cams 58 and the camming surfaces 60, which slide relative to each other in face contact as opposed to line contact.

As is indicated in FIG. 4, movement of the support arms 50 from the starting position shown to their finished full crimp position will result in the respective support arms 50 moving from the initial position Rs to the final position Rf. This in turn results in the respective jaws moving downwardly towards the camming surfaces 60 by the distance R, the geometry of the ramp cams 58 and camming surfaces 60 being such that the ramp cams 58 and the camming surfaces 60 are maintained substantially in continuous sliding engagement during closing of the support arms 50, which, as previously stated, will result in the jaws 52 moving downwardly by the distance R.

In the event that the jaws 52 were to be rigidly mounted on their respective support arms 50, the end faces of the jaws 52 would approach each other other than in parallelism. Parallelism of the end faces of the jaws 52 is accomplished by use of the camming members 56 and the camming surfaces 60 of the anvil 72.

As the jaws 50 move towards each other, the respective jaws 52 rotate within their support arms against the bias of the spring 62, this rotation being caused by the engagement of the ramp cams of the camming members 56 with the associated camming surfaces 60.

Optionally, the anvil 72 is free to rotate about a pivot 74 carried by the side plates 70, thus to provide a completely self-adjusting arrangement further ensuring that the jaws 52 approach each other in true parallelism.

Referring now to FIG. 5, which shows the effect of moving only one of the support arms 50*a*, it will be seen that the free end of the jaw 52, that initially extended a distance A beyond its associated support arm 50, has retreated to a distance B, while at the same time the camming member 58 has descended down the camming surface 60 by a distance C. The anvil 70, in the event that it is pivoted, is incapable of movement upon the engagement of the other camming surface 60 with the opposite camming member 56, i.e., without regard to which one of the jaws 52 is moving at any particular time, the entire system is maintained in symmetry with the end faces of the jaws 52 maintained in parallelism with each other.

In the event that a compression sleeve is not present between the jaws, then, the springs 62 and push rods 64 maintain the camming members 56 and their ramp cams 58 in proper surface engagement with the associated camming surface 60.

FIG. 6 illustrates the crimping tool when in a fully closed condition, the end faces of the respective jaws 52 having come into engagement one with the other, this position being the termination of a complete crimping operation on the compression sleeve.

As is known, the respective support arms 50 can be rotated by rollers 30 carried by a hydraulic ram 36 which is forced upwardly between the downward extending arm 76 of the respective support arms 50.

During reverse movement of the jaws 52 from the closed position illustrated in FIG. 6 to the open position illustrated in FIG. 3, firstly, the camming members 56 will ride up the camming surfaces 60, the respective jaws 52 at that time being rotated within their slides 54 by the bias imposed by the springs 62 and push rods 64, the ramp cams 58 and camming surfaces 60 remaining in surface engagement during this movement, until such time as the camming members 56 reengage the support arms 50, as illustrated in FIGS. 3 and 4.

Once the camming members 56 have engaged with their associated support arm 50, then, further rotation of the jaws 52 within the support arms 50 under the influence of the springs 62 is prevented. Continued opening movement of the support arms 50 will then lift the ramp cams 58 off the associated camming surfaces 60, this permitting the jaws to be moved to a fully opened position as illustrated in FIG. 3.

Of significance to the present invention is the fact that only two jaws are employed, this in turn providing for a greater sliding surface area between the jaws 52 and the respective support arms 50. Also, the camming action of the ramp cams 58 and their associated camming surfaces 60 proceeds in face-to-face surface engagement after initial line engagement, thus providing a maximized bearing surface area that is devoid of line contact.

Additionally, as the side plates 70 are only required to provide pivotal support for the respective support arms 50 and optionally the anvil 72, the side plates 70 can be of lighter weight than in the prior proposed constructions of crimping tools, which, tend to be cumberous, heavy and unwieldy, particularly in larger sizes of such crimping tools.

As the springs 62 are only required to return the jaws 52 to their initial position in which the camming members 56 are engaged with the support arm 50, those springs can be of relatively light weight. As will be apparent to persons skilled in the art, any other convenient means of biasing the jaws can be provided.

The respective members of the crimping tool conveniently can be manufactured by the known drop-stamping process, or, in the alternative, can be manufactured by a casting operation employing a non-crystalline malleable steel that is machined as necessary subsequent to the casting operation.

I claim:

1. A tool for crimping a compression sleeve employed in a compression coupling, including:

a support;

two support arms pivoted for arcuate movement about said support;

a crimping jaw slidably mounted on each said support arm for rotary sliding movement about an axis transverse to the longitudinal axis of said each said support arm;

a camming member on each said crimping jaw; means biasing said respective crimping jaws for rotation relative to the associated said support arm to a determined position relative to said support arm; and, a camming surface carried by said support; a ramp cam on each said camming member engageable in face engagement with said camming surface, said ramp cam being operative to rotate the associated said crimping jaw relative to the associated said support arm, to maintain end faces of the respective said crimping jaws in parallelism with each other during a crimping operation.

2. The tool of claim 1, in which said camming members on said respective crimping jaws are engageable with the associated said support arm, and said means for biasing said respective crimping jaws is operative to bias said camming members in a direction to engage said camming members with the associated said support arm.

3. The tool of claim 1, in which said support comprises parallelly spaced side plates and shafts carried by said side plates, and in which said respective support arms are positioned for pivotal arcuate movement about said shafts carried by said side plates.

4. The tool of claim 1, in which said biasing means is provided by springs carried by said respective support arms, and which react on said crimping jaws to bias said crimping jaws to said determined position.

5. The tool of claim 1, in which said respective camming surfaces are each provided on an anvil carried by said support.

* * * * *